United States Patent [19]

Chamberlain

[11] 4,127,952

[45] Dec. 5, 1978

[54] REPLACEABLE ADAPTER FOR AN EARTHWORKING TOOL

[75] Inventor: Richard W. Chamberlain, Aurora, Ill.

[73] Assignee: Caterpillar Tractor Co., Peoria, Ill.

[21] Appl. No.: 807,944

[22] Filed: Jun. 20, 1977

[51] Int. Cl.[2] ..... E02F 9/28

[52] U.S. Cl. ..... 37/141 R; 37/DIG. 12

[58] Field of Search ..... 37/141 R, 141 T, 142 R, 37/142 A, DIG. 3, 117.5, DIG. 12; 172/777, 713, 719; 214/145 R

[56] References Cited

U.S. PATENT DOCUMENTS

| | | | |
|---|---|---|---|
| 872,439 | 12/1907 | Livengood | 37/141 R |
| 1,772,624 | 8/1930 | Brendlin | 37/141 R |
| 1,963,847 | 6/1934 | Jersey | 37/141 R |
| 2,397,521 | 4/1946 | Askue | 37/142 R |
| 2,688,910 | 9/1954 | Adair | 37/142 R |
| 2,701,591 | 2/1955 | Kissner et al. | 37/141 R |
| 3,014,293 | 12/1961 | Boatman et al. | 37/141 R |
| 3,021,626 | 2/1962 | Eyolfson | 37/141 R X |
| 3,103,752 | 9/1963 | Rockwell | 37/141 R |
| 3,497,973 | 3/1970 | Campbell | 37/141 R |
| 3,621,594 | 11/1971 | Hahn et al. | 37/141 T |
| 3,997,988 | 12/1976 | Klett | 37/142 R X |
| 4,043,060 | 8/1977 | Stepe | 37/117.5 X |

*Primary Examiner*—Clifford D. Crowder
*Attorney, Agent, or Firm*—Charles E. Lanchantin, Jr.

[57] ABSTRACT

A replaceable adapter is secured to an earthworking tool having a floor with a bottom surface, a leading edge, a top surface, and an upwardly facing inclined front surface between the top surface and the cutting edge. The adapter includes a bifurcated body portion having a rearwardly extending upper arm, a rearwardly extending lower arm, and a forwardly extending nose, and an integral wing portion having a rearwardly extending lower arm and a forwardly extending cutting edge. The adapter is of a construction such that the bifurcated body portion is engaged against the bottom surface and the inclined front surface of the floor, the body and wing portions are disposed below the top surface of the floor, and the lower arms of the body and wing portions are secured against the bottom surface of the floor at laterally offset locations.

8 Claims, 4 Drawing Figures

REPLACEABLE ADAPTER FOR AN EARTHWORKING TOOL

BACKGROUND OF THE INVENTION

The present invention is related to a replaceable adapter for an earthworking tool, and more particularly to a plurality of such adapters for use on the front end of an ejector bucket or the like.

Ejector-type loader buckets, such as those exemplified by U.S. Pat. No. 3,426,968 issued Feb. 11, 1969 to T. G. Campbell, include a laterally extending front cutting edge which is subject to wear as a result of performing its usual cleanup and earthmoving operations. When the cutting edge thereof is worn, it is removed by a cutting torch and a new edge welded onto the body of the bucket at considerable expense.

In certain work applications where a more aggressive type of bucket is desired, a plurality of adapters are secured to the cutting edge so that hardened and replaceable wear tips can be mounted on the forward ends thereof. The large majority of such adapters are of bifurcated construction to enable them to straddle the cutting edge and to prevent their dislodgement upon being exposed to high working forces. Unfortunately, the usual adapter extends above the level of the bucket floor so that it would interfere with the forward movement of the ejector blade as it discharges the load from within the bucket. For this reason, and for decreasing the resistance to penetration of the cutting elements into the earth, it is preferable to provide a compact adapter construction in the vertical direction. Moreover, with the ususal narrow adapter the cutting edge would not be protected from wear between the adapters.

Still another problem concerns the matter of directing high working forces through the individual adapters to the bucket without failure of the bolts or welds used to secure the adapters thereto. For example, conventional adapters are narrow, so that they do not bear sufficiently against the bucket to resist certain twisting forces or transverse forces. On the other hand, if a full width replaceable cutting edge and adapter assembly is utilized, it would be excessively large for convenient handling and would be subject to premature replacement because of wear or damage to but one part thereof.

SUMMARY OF THE INVENTION

The present invention is directed to overcoming one or more of the problems as set forth above.

According to the present invention, there is provided a replaceable adapter for an earthworking tool having a floor with a bottom surface, a leading edge, a top surface, and an upwardly facing inclined front surface between the top surface and the cutting edge. The adapter includes a bifurcated body portion having a rearwardly extending upper arm, a rearwardly extending lower arm, and a forwardly extending nose, and an integral wing portion having a rearwardly extending lower arm and a forwardly extending cutting edge portion. The adapter is of a construction such that the bifurcated body portion is engaged against the bottom surface and the inclined front surface of the floor, the body and wing portions are disposed below the top surface of the floor, and the lower arms of the body and wing portions are secured against the bottom surface of the floor at laterally offset locations.

DESCRIPTION OF THE INVENTION

Figure 1:
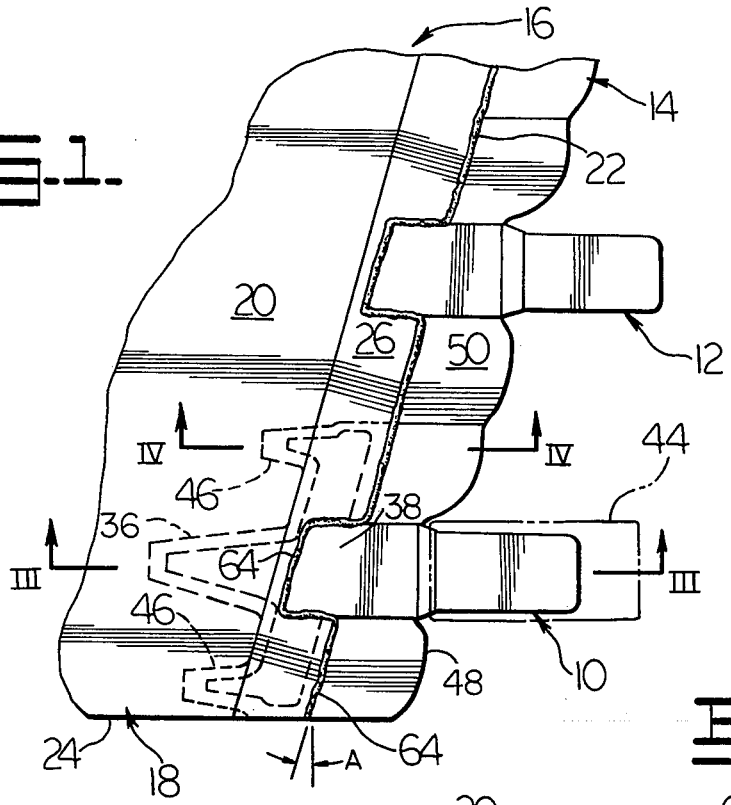
FIG. 1 is a fragmentary and diagrammatic top plan view of an earthworking tool including a plurality of replaceable adapters constructed in accordance with the present invention.
Figure 3:
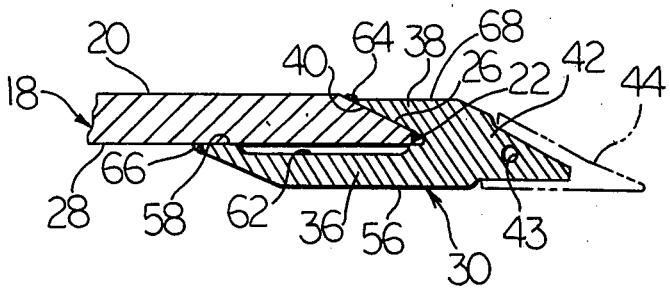
FIG. 3 is a longitudinal sectional view of the earthworking tool and adapter construction shown in FIG. 1 as taken along the line III—III thereof.

Referring initially to FIG. 1 of the drawings, a plurality of replaceable adapters 10, 12, and 14 constructed in accordance with the present invention, are shown as being attached to an earthmoving tool 16 such as a loader bucket. This bucket is preferably of the ejector type as described in U.S. Pat. No. 3,426,968 mentioned above, the contents of which are incorporated herein by reference as though fully set forth in detail herein. Such a bucket typically includes a floor 18 having a top surface 20, and a leading edge 22 which is symmetrically oppositely inclined at an agle A with respect to a pair of opposite side edges 24, only one of which is shown. It also typically includes an upwardly facing inclined or tapered front surface 26 disposed between the top surface and the leading edge, and a bottom surface 28 as shown in FIG. 3.

Figure 2:
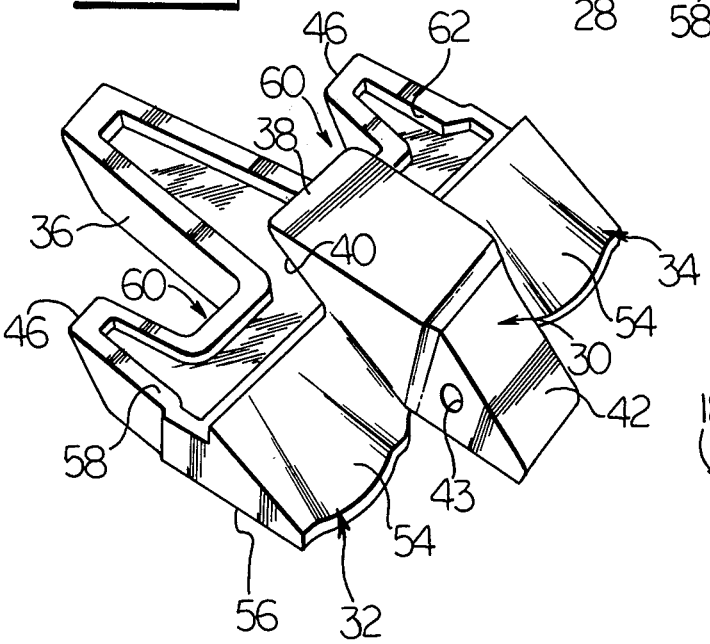
FIG. 2 is a diagrammatic and perspective view of one of the replaceable adapters illustrated in FIG. 1.

As best shown in FIG. 2, the adapter 10 on the right hand front corner of the bucket 16 has a bifurcated body portion 30 and a pair of similar wing portions 32 and 34 on either side thereof. As illustrated also in FIG. 3, the central bifurcated portion of the adapter has a lower arm 36 and an upper arm 38, with the upper arm defining a downwardly facing tapered surface or shoulder 40. Further, the bifurcated body portion has a wear-tip receiving nose portion 42 which extends forwardly of the wing portions in a converging manner. A transversely extending and pin-receiving opening 43 is defined within the nose portion so that a conventional wear tip 44, shown in phantom in FIGS. 1 and 3, may be installed thereon by preferably a retaining pin arrangement of the usual type, not shown.

Figure 4:
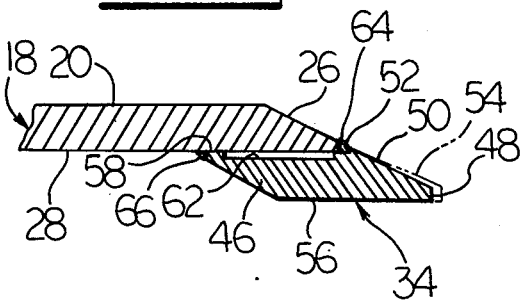
FIG. 4 is a longitudinal sectional view comparable to FIG. 3 only taken along the line IV—IV in FIG. 1.

It is apparent when viewing FIG. 2 that the wing portions 32 and 34 of the adapter 10 are essentially mirror images of one another so that only one need be described herein. Particularly, and as shown in FIG. 4, the wing portion 34 has a lower arm 46, a forwardly extending cutting edge 48, an upwardly facing inclined or tapered front surface 50 leading back from the cutting edge, and a rearwardly facing upright shoulder 52 between the lower arm and the tapered surface. Advantageously, while the tapered front surface 50 is arranged in a substantially coplanar relationship to the tapered front surface 26 of the bucket floor 18, a slight bulge 54 is preferably provided centrally of each wing portion. The broken line in FIG. 4 is representative of the additional thickness of material provided by each of the forwardly disposed bulges for an extended adapter wear life.

More specifically, it may be seen that the bifurcated portion 30 and the wing portions 32 and 34 define an irregularly shaped common bottom surface 56 and common rear shelf surface 58. It is further apparent from FIG. 2 that the irregular shape of the adapter 10 is due in part to a pair of weight-reducing notches, identified generally by the reference numerals 60, which are defined between the lower arms 46 of the wing portions and the lower arm 36 of the central body portion. Additional weight reduction is preferably effected by the formation of a common depression 62 formed in the shelf surface 58 and generally following the irregular contour of the arms and notches.

In operation, the adapter 10 is placed against the floor 18 of the bucket 16 so that the rearwardly facing and coextensive shoulders 52 of the wing portions 32 and 34 are juxtaposed against the leading edge 22 of the floor. Moreover, the shelf surface 58 is disposed in abutment against the bottom surface 28 of the floor. With such relationship established, an upper weld joint 64 and a lower weld joint 66 is deposited between the adapter and the bucket floor. It is evident that the upper weld joint not only extends generally along the shoulders 52, but also circuitously about the upper arm 38 as shown in FIGS. 1, 3 and 4. Likewise, the lower weld joint is irregularly shaped and advantageously greatly elongated for additional strength because it follows the boundary edges of the arms 36 and 46.

In accordance with one aspect of the invention, the construction and arrangement of the adapter 10 and bucket floor 18 is such that a top surface 68 of the adapter is preferably substantially coplanar with the top surface 20 of the floor as shown in FIG. 3. With such construction, the adapter does not interfere with the ejection of material from within the bucket, and a vertically thin profile is provided for improved penetration into the earth or the like. However, it is to be appreciated that the elevation of the top surface 68 could be lowered somewhat from such coplanar relationship without departing from the spirit of the present invention.

Furthermore, while two wing portions 32 and 34 have preferably been provided to better transfer working forces rearwardly into the bucket floor 18, it is to be appreciated that in some instances only a single wing portion may be needed for stabilizing purposes. With such alternate construction, the single wing portion would still retain a half-arrow configuration in longitudinal cross section as is illustrated in FIG. 4, and only a single notch 60 would be defined between the lower arms 36 and 46 thereof.

Other aspects, objects, and advantages of the invention can be obtained from a study of the drawings, disclosure, and the appended claims.

The embodiments of the invention in which an exclusive property or privilege is claimed are defined as follows:

1. A replaceable adapter (10), for an earthworking tool (16) having a normal working direction of travel and including a floor (18) having a bottom surface (28), a leading edge (22), a top surface (20), and an upwardly facing inclined front surface (26) between the top surface (20) and the leading edge (22), comprising:

a bifurcated body portion (30) having a rearwardly extending upper arm (38), a rearwardly extending lower arm (36), and a forwardly extending nose portion (42); and a wing portion (32) having a rearwardly extending lower arm (46), forwardly extending cutting edge (48), and an upwardly facing inclined front surface (50), said wing portion (32) being integrally connected to said body portion (30), said adapter (10) being connected to said tool (16) such that said body portion (30) is engaged against said bottom surface (28) and said inclined front surface (26) of said floor (18), said body and wing portions (30,32) are disposed substantially below said top surface (20) of said floor (18), said lower arms (36,46) of said body and wing portions (30,32) are secured against said bottom surface (28) of said floor (18) at laterally offset locations, and said inclined front surfaces (26,50) are arranged in substantially coplanar relation.

2. The replaceable adapter (10) of claim 1 wherein said wing portion (32) has a rearwardly facing upright shoulder (52), and said adapter (10) is connected to said tool (16) by a weld joint (64) between said shoulder (52) and said leading edge (22) of said floor (18).

3. The replaceable adapter (10) of claim 1 wherein said lower arm (36) of said body portion (30) extends rearwardly a greater distance than said lower arm (46) of said wing portion (32), said lower arms (36,46) being in generally close proximity and defining a weight reducing notch (60) therebetween.

4. The replaceable adapter (10) of claim 3 wherein said lower arms (36,46) and said notch (60) define a circuitous perimeter, and said adapter (10) is connected to said tool (16) by an extended weld joint (66) located at said circuitous perimeter.

5. The replaceable adapter (10) of claim 3 including a second wing portion (34) connected to said body portion (30) on the laterally opposite side of said body portion (30) than said wing portion (32).

6. A replaceble adapter (10), for an earthworking tool (16) having a normal working direction of travel and including a floor (18) having a bottom surface (28), a leading edge (22), a top surface (20), and an upwardly facing inclined front surface (26) between the top surface (20) and the leading edge (22), comprising:

a bifurcated body portion (30) having a rearwardly extending upper arm (38), a rearwardly extending lower arm (36), and a forwardly extending nose portion (42); and first and second wing portions (32,34) integrally connected to said body portion (30) at the laterally opposite sides thereof, each of said wing portions (32,34) having a rearwardly extending lower arm (46), a forwardly extending cutting edge (48) and an upwardly facing inclined surface (50), said adapter (10) being weldably connected to said tool (16) such that said body portion (30) is interlockingly engaged against said bottom surface (28) and said inclined front surface (26), and said lower arms (46) of said wing portions (32,34) are engaged against said bottom surface (28) in generally close proximity to said lower arm (36) of said body portion (30) in a load stabilizing manner.

7. The replaceable adapter (10) of claim 6 wherein each of said lower arms (46) of said wing portions (32,34) defines a weight reducing notch (60) with said lower arm (36) of said body portion (30).

8. The replaceable adapter (10) of claim 6 wherein said wing portions (32,34) individually define an upwardly facing inclined front surface (50), said inclined front surfaces (50) of said wing portions (32,34) being substantially coplanar with said inclined front surface (26) of said floor (18).

* * * * *